US010502395B2

(12) United States Patent
Tan

(10) Patent No.: US 10,502,395 B2
(45) Date of Patent: Dec. 10, 2019

(54) LED DOWNLIGHT CAPABLE OF REGULATING ILLUMINATION ANGLE

(71) Applicant: Treasure Best Ltd., Dongguan, Guangdong Province (CN)

(72) Inventor: Yiyi Tan, Dongguan (CN)

(73) Assignee: Treaure Best Ltd., Dongguan (CN)

( * ) Notice: Subject to any disclaimer, the term of this patent is extended or adjusted under 35 U.S.C. 154(b) by 149 days.

(21) Appl. No.: 15/695,048

(22) Filed: Sep. 5, 2017

(65) Prior Publication Data

US 2019/0072258 A1 Mar. 7, 2019

(51) Int. Cl.

| | |
|---|---|
| ***F21V 14/02*** | (2006.01) |
| ***F21V 21/30*** | (2006.01) |
| ***F21V 29/77*** | (2015.01) |
| ***F21V 29/71*** | (2015.01) |
| ***F21S 8/02*** | (2006.01) |
| ***F21K 9/20*** | (2016.01) |
| ***F21V 19/02*** | (2006.01) |
| *F21Y 115/10* | (2016.01) |
| *F21Y 105/10* | (2016.01) |

(52) U.S. Cl.

CPC ..... *F21V 14/02* (2013.01); *F21K 9/20* (2016.08); *F21S 8/026* (2013.01); *F21V 19/02* (2013.01); *F21V 21/30* (2013.01); *F21V 29/713* (2015.01); *F21V 29/77* (2015.01); *F21Y 2105/10* (2016.08); *F21Y 2115/10* (2016.08)

(58) Field of Classification Search

CPC ..... F21V 21/28; F21V 21/30; F21V 14/02
See application file for complete search history.

(56) References Cited

U.S. PATENT DOCUMENTS

| | | | | |
|---|---|---|---|---|
| 9,982,855 | B1 * | 5/2018 | Tan | F21V 3/061 |
| 2009/0040782 | A1 * | 2/2009 | Liu | F21V 19/001 362/555 |

* cited by examiner

*Primary Examiner* — Suezu Ellis
(74) *Attorney, Agent, or Firm* — Alan D. Kamrath; Karin L. Williams; Mayer & Williams PC

(57) ABSTRACT

A LED downlight capable of regulating illumination angle is composed of a light source device, a swing component, a light distribution mechanism, a rotation component, a casing component and a power source device. The swing component is disposed at a bottom surface of the light source device. The light distribution mechanism is disposed at the bottom surface of the light source device. The rotation component is coupled to the swing component. The casing component is located at a bottom of the swing component. The power source device is disposed at a periphery and connected by a wire to supply power to the light source device. The rotation component can be operated to perform horizontal rotation, and the swing component can be operated to carry out vertical swing during usage so that a user selects and regulates required beam projection direction and angle to have powerful practicality in illumination.

13 Claims, 15 Drawing Sheets

LED DOWNLIGHT CAPABLE OF REGULATING ILLUMINATION ANGLE

BACKGROUND OF THE INVENTION

Field of the Invention

The present invention relates to a light emitting diode (LED) downlight, and more particularly to a LED downlight capable of horizontal rotation and vertical swing in bidirectional rotation so as to regulate an illuminating angle.

Description of the Related Art

A LED downlight is a common and extensively used illuminating lamp. A conventional LED downlight has a configuration for downwardly illuminating without a bidirectional rotation function capable of horizontally rotating and vertically swinging. Therefore, the illuminating angle of the LED downlight is unable to be regulated during usage. For people who need to frequently regulate an illuminating angle, the conventional LED downlight is inconvenient and requires improvements.

SUMMARY OF THE INVENTION

In view of the aforementioned drawbacks of the prior art, the inventor of the invention conducted research and experiments, and developed a LED downlight capable of regulating an illumination angle in accordance with the invention to overcome the drawbacks of the prior art.

Therefore, it is a primary objective of the invention to provide a LED downlight that conveniently regulates a required beam projection direction and angle by operating horizontal rotation and vertical swing as bidirectional rotation.

To achieve the above mentioned object, the invention relates to a LED downlight capable of regulating an illumination angle composed of at least a light source device, a swing component, a light distribution mechanism, a rotation component, a casing component and a power source device. The light source device includes a heat sink, an LED light source and a support rack, the heat sink composed of a central solid body outwardly arranged to show heat dissipation slices of scattered arrangement, the LED light source supported by the support rack and coupled to a bottom surface of the heat sink, and a center of the support rack opened with a large piercing hole provided for the LED light source to downwardly project a LED beam.

The swing component includes an upper sliding vane and a lower guide flake, with the upper sliding vane having a main slice body having two sets of opposite sides, having a curvature-like shape and a large center hole at its center and disposed with a set of through holes on one set of two opposite side edges and raised with a coupling grip at the other set of opposite side edges The lower guide flake includes a main sheet body having two sets of opposite sides, having a curvature-like shape and a large slot, the curvature of the main sheet body of the lower guide flake corresponding to the curvature of the main slice body of the upper sliding vane, the main sheet body of the lower guide flake respectively disposed with a narrow guide slot on two opposite side edges and downwardly bent at the other set of opposite side edges to form a support sheet body, a bottom of the support sheet body further bent to form a coupling sheet body. The upper sliding vane is placed on the lower guide flake so that the through holes on the two side edges of the upper sliding vane respectively align with the narrow guide slots on the two side edges of the lower guide flake, with a regulation screw member passing through a lower gasket, an elastic member and an upper gasket and locked with a nut after passing through the narrow guide slot of the lower guide flake and the through hole of the upper sliding vane, the nut pushed to downwardly prop the main slice body of the upper sliding vane to attach the main sheet body of the lower guide flake through effect of elastic force of the elastic member.

The light distribution mechanism includes at least one fastening cylinder and a light distribution member, and wherein a top portion and a bottom portion of the fastening cylinder opened to inwardly form an accommodation space, the fastening cylinder remaining a shield wall at bottom periphery, a wall body of the top portion of the fastening cylinder opened with a plurality of slots, the light distribution member accommodated in the accommodation space of the fastening cylinder to be supported by the shield wall, and the slot of the fastening cylinder further snapped with a bottom surface of the heat sink. The light distribution mechanism and a combination body of the LED light source and the support rack vertically pass through the large center hole and the large slot of the swing component to allow the bottom surface of the heat sink to be in contact with the coupling grip of the upper sliding vane. A coupling member further passes through the coupling grip to couple the bottom surface of the heat sink.

The rotation component includes at least an upper rotation ring and an upper fastening ring. The upper rotation ring is a ring-like body opened with a large piercing hole at its center and disposed with at least two sets of coupling holes synchronously disposed near an inner edge. The upper fastening ring is a ring body having a large piercing hole at its center, the ring body further divided into an external ring wall and an inner ring wall, the inner ring wall being higher than the external ring wall. The rotation component is incorporated with a support rack mechanism, the support rack mechanism having a plate body, the plate body opened with a large mounting hole. The upper rotation ring is placed on the plate body of the support rack mechanism, the large piercing hole of the upper rotation ring aligning the large mounting hole of the plate body to cover the inner ring wall of the upper fastening ring on the upper rotation ring, after the external ring wall of the upper fastening ring attaching the plate body, a coupling member coupling the plate body by passing through the external ring body of the upper fastening ring; a connecting sheet body of the lower guide flake in the swing component attached on the upper rotation ring, a coupling member passing through the connecting sheet body to couple the upper rotation ring.

The casing component has a reflective mask, the reflective mask having a narrow upper portion and a wide lower portion and formed with a wall at a bottom edge of an external surface and having a cone-like light hole, which is vertically penetrated and shows the narrow upper portion and the wide lower portion, at its center, the light hole further comprising an inclined-like side hole disposed toward a side except a top surface portion, an external surface of the reflective mask having at least two coupling walls synchronously disposed; the reflective mask accommodated in the large mounting hole of the plate body of the support rack mechanism.

The power source device is further disposed on the plate body of the support rack mechanism and introduced by receiving supply mains to perform circuit finishing work of regulator rectification therein, thereby transmitting and driving the LED light source to emit light.

According to the above-mentioned LED downlight capable of regulating illumination angle, the light distribution member is a lens or a reflective cup.

According to the above mentioned LED downlight capable of regulating illumination angle, the light distribution mechanism includes a lens, with the lens accommodated in the accommodation space of the fastening cylinder to be supported by the wall during assembling, and the light distribution member being further accommodated in the accommodation space to be supported by the lens.

According to the above-mentioned LED downlight capable of regulating illumination angle, the rotation component further includes a lower rotation ring, a center of the lower rotation ring having a large piercing hole, three arc strip grooves uniformly surrounding the ring body, the lower rotation ring being attached to a bottom surface of the plate body during assembling, the large piercing hole of the lower rotation ring aligning the large mounting hole of the plate body, and a coupling member coupled to the plate body after passing through the arc strip groove of the lower rotation ring.

According to the above-mentioned LED downlight capable of regulating illumination angle, the casing component includes a coupling frame, the coupling frame coupled to a bottom surface of the large piercing hole of the lower rotation ring, a clamping member being snapped at a periphery bottom edge of the coupling ring, and the reflective mask is accommodated from a bottom edge of the coupling ring until the coupling wall of the reflective mask crosses over the clamping member of the coupling frame.

According to the above-mentioned LED downlight capable of regulating illumination angle, the casing member includes a decoration frame having a planar decoration tray while a standing wall raises from its middle, the upper rotation ring is downwardly disposed with a vertical wall at a periphery of the large piercing hole to push the standing wall of the decoration ring into the vertical wall of the lower rotation ring, and the reflective mask is accommodated from a bottom edge of the decoration frame until the coupling wall of the reflective mask crosses over the standing wall of the decoration frame.

According to the above-mentioned LED downlight capable of regulating illumination angle, the casing member includes a coupling frame, and wherein the coupling frame being directly attached to a bottom surface of the large mounting hole of the plate body, a clamping member being snapped at a periphery bottom edge of the coupling frame, and the reflective mask being accommodated from a bottom edge of the coupling frame until the coupling wall of the reflective mask crosses over the clamping member of the coupling frame.

According to the above-mentioned LED downlight capable of regulating an illumination angle, the casing component includes a decoration frame having a planar decoration tray while a standing wall raises from its middle, the coupling frame is first attached and coupled to a bottom surface of the large mounting hole of the plate body, the standing wall of the decoration ring is pushed into the coupling fame, and the reflective mask accommodated from a bottom edge of the decoration frame until the coupling wall of the reflective mask crosses over the standing wall of the decoration frame.

According to the above-mentioned LED downlight capable of regulating an illumination angle, at least three sets of downwardly-protruding bottom flanges are disposed on a wall body of the upper rotation ring.

According to the above-mentioned LED downlight capable of regulating illumination angle, an upwardly protruding positioning bump is disposed on the wall body of the upper rotation ring, and a position limiting bump is disposed at an inner edge of the inner ring wall of the upper fastening ring, and wherein the positioning bump is limited by the position limiting bump while rotating the upper rotation ring so that it merely being rotated in one direction and then reversely rotated.

According to the above-mentioned LED downlight capable of regulating illumination angle, a packing member is screwed on the wall body of the upper rotation ring to position the upper rotation ring through packing effect.

According to the above-mentioned LED downlight capable of regulating illumination angle, an insulation case covers the plate body of the support rack mechanism to cover a portion of the downlight above the plate body so that the insulation case is in contact with a fireproof foam, thereby increasing a fireproof effect.

According to the LED downlight capable of regulating illumination angle, the power source device includes a junction box and a driver, the junction box supplied by supply mains to conduct power to the driver, and the driver performing circuit finishing work of regulator rectification therein, thereby transmitting power and driving the LED light source to emit light.

DETAILED DESCRIPTION OF THE PREFERRED EMBODIMENTS

The technical characteristics, contents, advantages and effects of the present invention will be apparent with the detailed description of a preferred embodiment accompanied with related drawings as follows.

Figure 1:
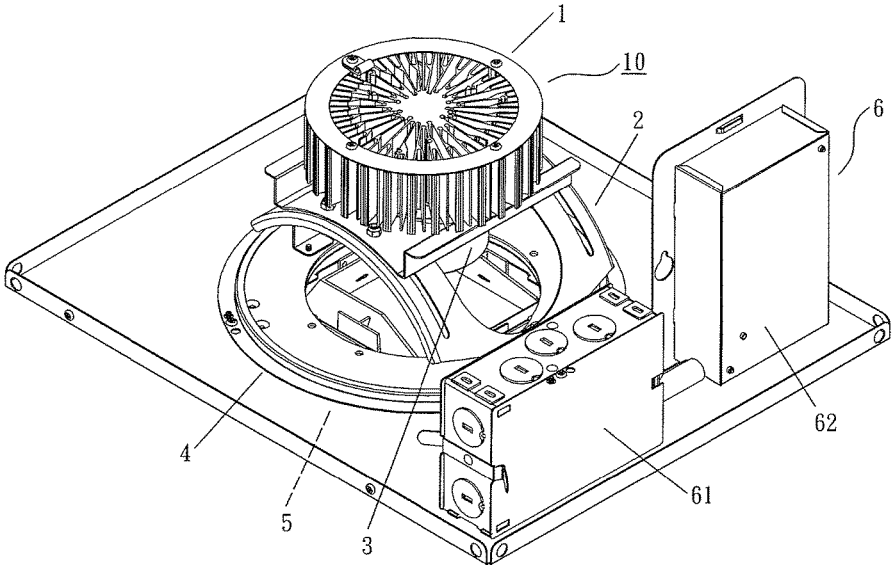
FIG. 1 is a three-dimensional drawing of an assembly according to an embodiment of the invention.
Figure 2:
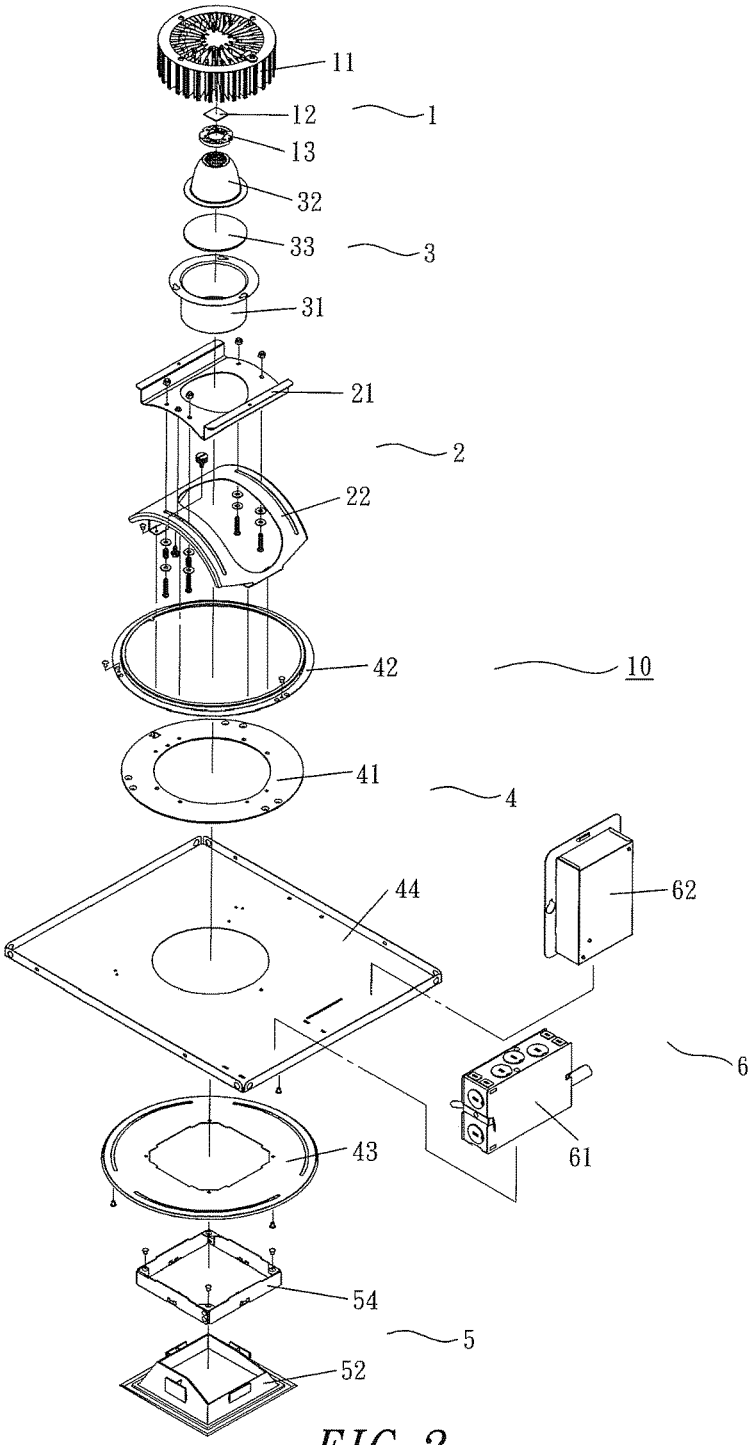
FIG. 2 is a three-dimensional decomposition drawing of a depression angle according to an embodiment of the invention.
Figure 3:
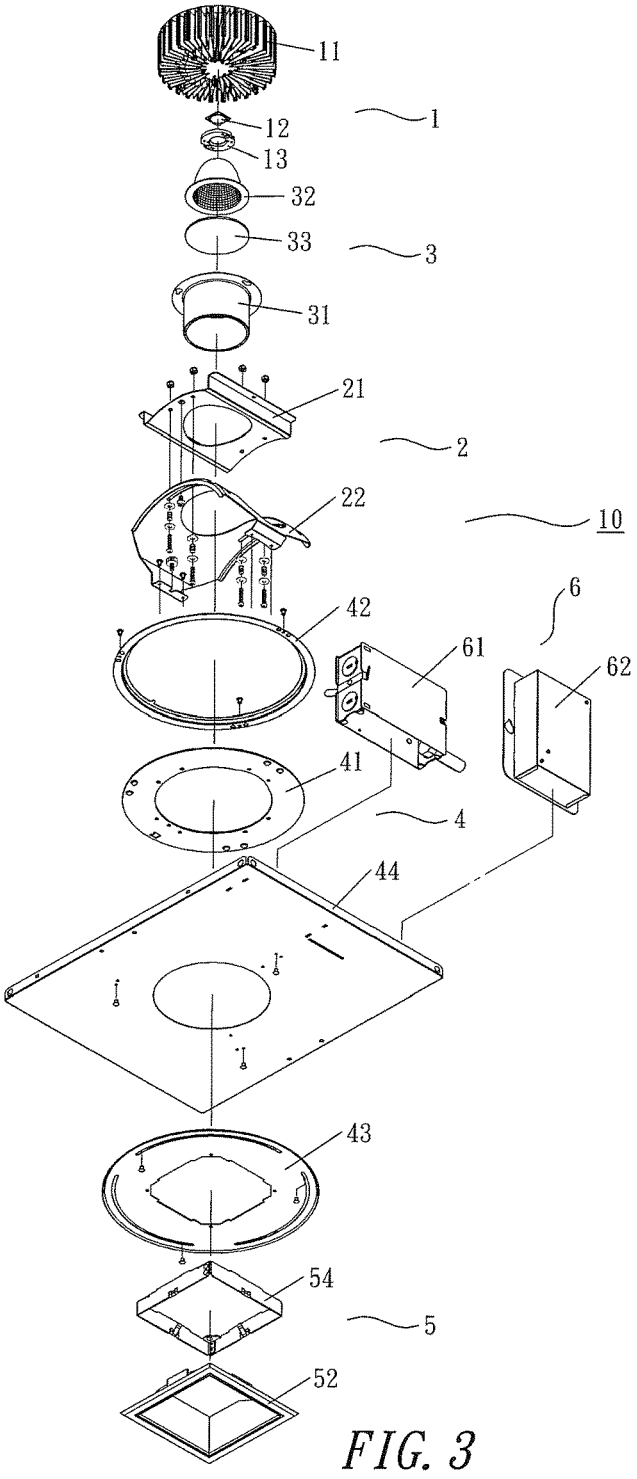
FIG. 3 is a three-dimensional decomposition drawing of an elevation angle according to an embodiment of the invention.
Figure 4:
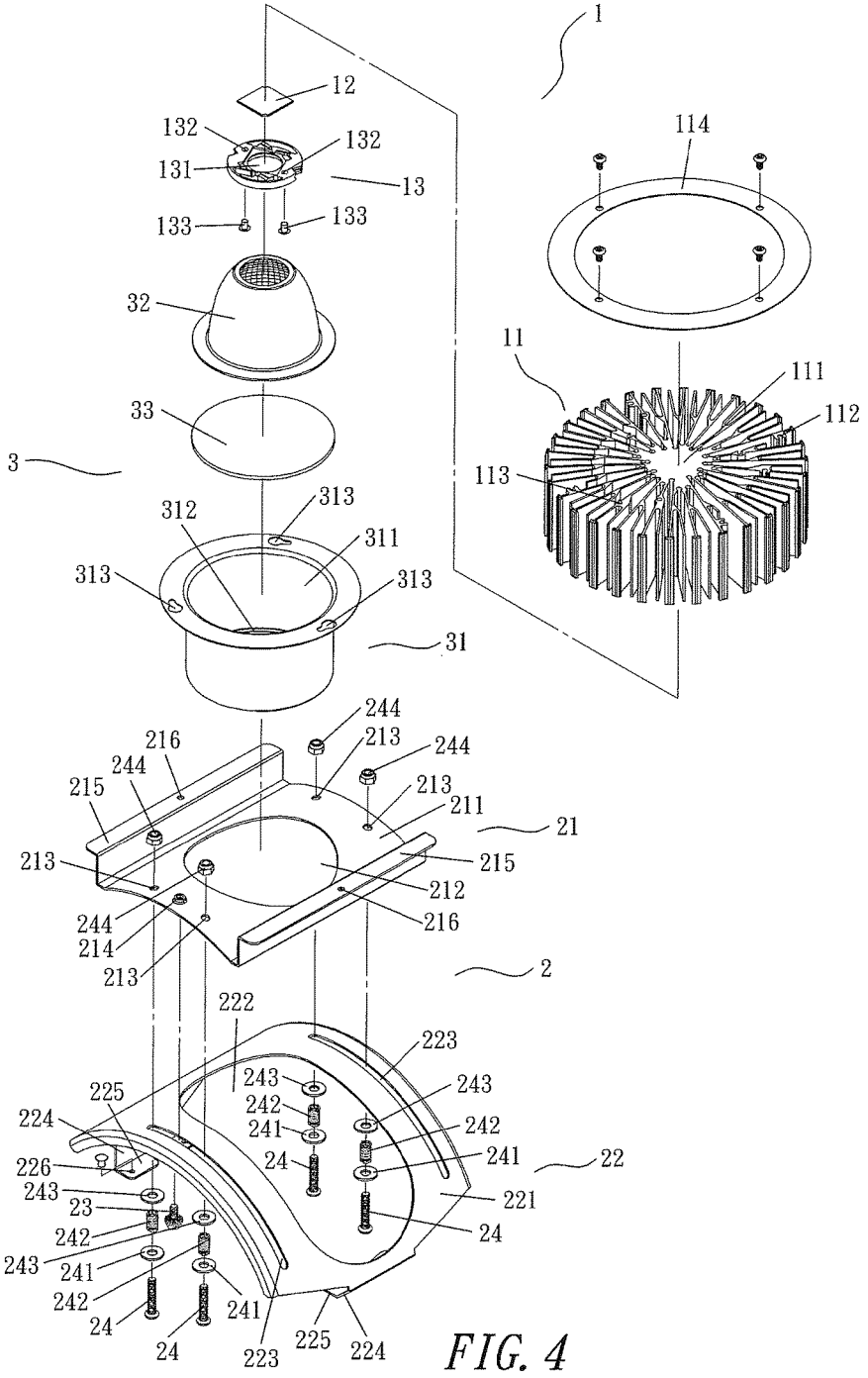
FIG. 4 is a three-dimensional decomposition drawing of a depression angle for partial structure in an embodiment of the invention.
Figure 5:
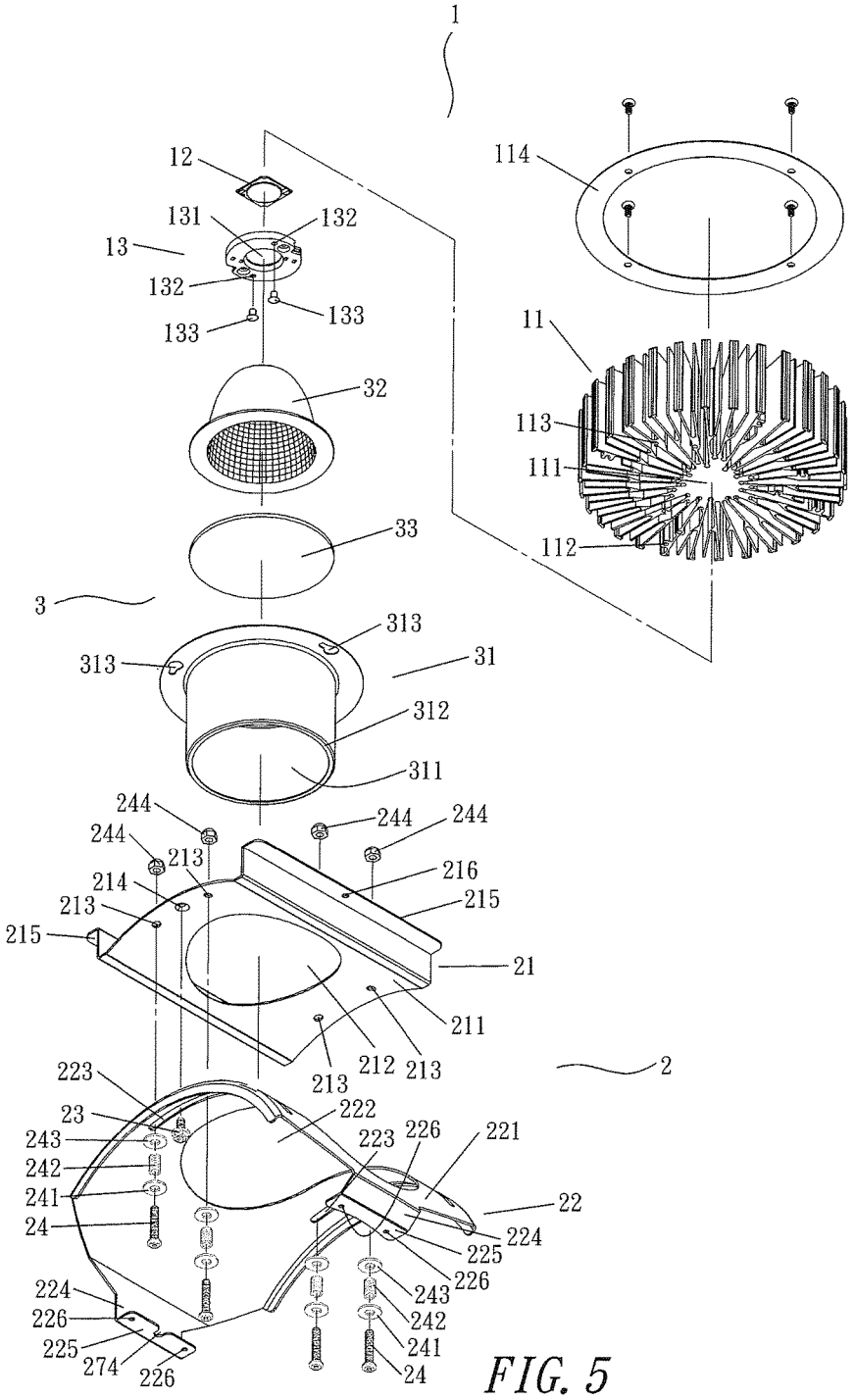
FIG. 5 is a three-dimensional decomposition drawing of an elevation angle for partial structure in an embodiment of the invention.

With reference to FIG. 1 for a downlight 10 according to an embodiment of the invention, and more particularly to an LED downlight that regulates a beam projection angle by operating horizontal rotation and vertical swing as a bidirectional rotation function. The downlight 10 is composed of a light source device 1, a swing component 2, a light distribution mechanism 3, a rotation component 4, a casing component 5 and a power source device 6.

With reference to FIGS. 2-5, the light source device 1 is composed of a heat sink 11, an LED light source 12 and a support rack 13. The heat sink 11 is composed of a central solid body 111 outwardly arranged to show heat dissipation slices of scattered arrangement. The foregoing whole can be, but is not limited to, a cylinder-shape or approximately square column. The heat sink 11 is disposed with a plurality of vertically external coupling hole columns 112 near an external ring, its top surface and bottom surface formed into coupling holes while a plurality of internal coupling hole columns 113 is simultaneously disposed near an inner ring, its top surface and a bottom surface also formed into coupling holes, with bottom coupling holes of several internal coupling hole columns 113 are locked with coupling members in advance so that they are coupled with a fastening cylinder 31 of the light distribution mechanism 3. The heat sink 11 further includes a ring piece 114 passed by a plurality of coupling members (screw bolts for example) to lock the coupling hole of the top surface of the external coupling hole columns 112 such that the ring piece 114 is disposed at a top surface external ring of the heat sink 11 to retain the heat sink 11. The LED light source 12 downwardly projects LED beam. A large piercing hole 131 is opened at the center of the support rack 13, its periphery designed as micro-recess and having several piercing holes 132. The LED light source 12 is supported by the micro-recess of the support rack 13. Moreover, several coupling members 133 (for example: screw bolts) are utilized to correspondingly lock the coupling hole on the bottom surface of the coupling hole columns 113 pre-set on the inner ring of the heat sink 11 after passing through the piercing hole 132 of the support rack 13 so that the LED light source 12 stays at the bottom surface of the central solid body 111 of the heat sink 11. Therefore, the LED beam projected by the LED light source 12 would pass through the large piercing hole 131 of the center of the support rack 13 to downwardly irradiate without obstruction. Furthermore, generated heat can be upwardly scattered to enter the solid body 111 and dissipate outwardly and quickly through the scattered-like arranged heat dissipation slices.

Figure 12:
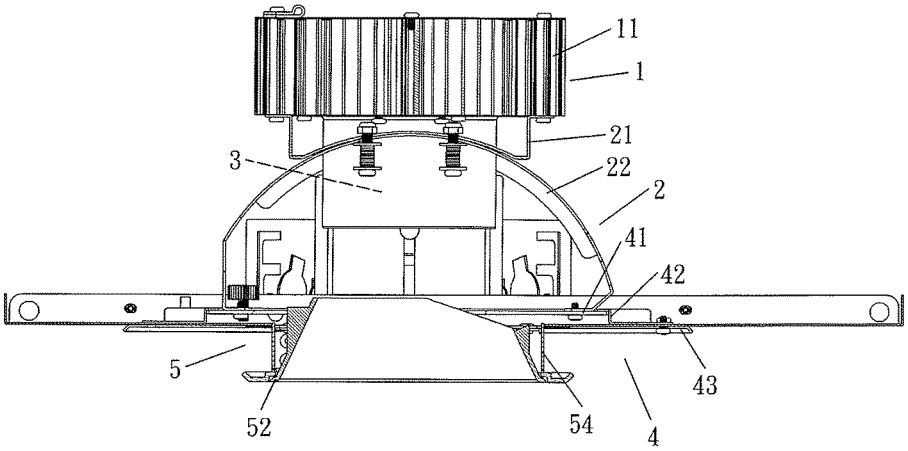
FIG. 12 is a front elevation drawing of a first using status according to an embodiment of the invention.

With reference to FIGS. 2-5, the swing component 2 is composed of an upper sliding vane 21 and a lower guide flake 22. The upper sliding vane 21 has a main slice body 211 having two sets of opposite sides and a curvature-like shape. The main slice body 211 is opened with a large center hole 212 at its center and has a set of through holes 213 on two opposite side edges, wherein a positioning screw hole 214 is further disposed between through holes 213 at one side. A coupling grip 215 is respectively raised at the other set of opposite side edges. A coupling hole 216 is opened at a middle portion of each coupling grip 215. The lower guide flake 22 has a main sheet body 221 with two sets of opposite sides and having a curvature-like shape. A curvature of the main sheet body 221 corresponds to a curvature of the main slice body 211. A large slot 222 is opened at the center of the main sheet body 221. A narrow guide slot 223 is respectively disposed on one set of two opposite side edges of the lower guide flake 22. A support sheet body 224 is formed on the other set of two opposite side respectively and downwardly bending from each edge. A bottom of the support sheet body 224 is further inwardly bent to form a coupling sheet body 225. A set of connecting holes 226 is disposed on each coupling sheet body 225, with a positioning recess 274 further disposed between the connecting holes 226 at one of the sides. The assembling of the swing component 2 is shown in FIGS. 1, 12. The upper sliding vane 21 is placed on the lower guide flake 22 to allow through holes 213 on the two side edges of the upper sliding vane 21 to respectively align with the narrow guide slots 223 on the two side edges of the lower guide flake 22. At the same time, the positioning screw hole 214 also aligns with one of the narrow guide slots 223. Therefore, a positioning member 23 is coupled and positioned to the positioning screw hole 214 of the upper sliding vane 21 after passing through the narrow guide slots 223 from the bottom to the top. Moreover, a regulation screw member 24 passes through a lower gasket 241, an elastic member 242 and an upper gasket 243 and locks with a nut 244 after upwardly passing through the narrow guide slot 223 of the lower guide flake 22 and each through hole 213 of the upper sliding vane 21. Accordingly, with the co-effect of the elastic force of the elastic member 242, the nut 244 can be pushed to downwardly prop the main slice body 211 of the upper sliding vane 21 to attach and position the main sheet body 221 of the lower guide flake 22. While using hands to upwardly lift the coupling grip 215 at two sides of the upper sliding vane 21, each lower gasket 241 would push correspondingly elastic member 242 to upwardly move so that the main slice body 211 of the upper sliding vane 21 is attached to the main sheet body 221 of the lower guide flake 22 without pressing. The upper sliding vane 21 can be entirely lifted to move along the direction of the lower guide flake 22. After reaching proper position, the main slice body 211 of the upper sliding vane 21 is re-attached and positioned to the main sheet body 221 of the lower guide flake 22 through co-pushing of elastic force of the elastic member 242 as long as the lifting of the coupling grips 215 at two sides of the upper sliding vane 21 is released.

With reference to FIGS. 2-5, the light distribution mechanism 3 is composed of a fastening cylinder 31, a light distribution member 32 and a lens 33. A top portion and a bottom portion of the fastening cylinder 31 are opened to inwardly form an accommodation space 311. A shield wall 312 is at bottom periphery. A wall body of the top portion of the fastening cylinder 31 is opened with a plurality of slots 313 composed of a wide slot portion and a narrow slot portion. There are at least two slots 313. The slots are preferably disposed at three places. The light distribution member 32 can be a reflective cup or a lens based upon demand. The reflective cup or the lens are one of the light distribution member 32, and a user can selectively replace different light distribution members (the reflective cup or the lens) based upon the demand for illuminated articles or an illuminated environment. The lens 33 can be, but is not limited to, a transparent lens or a filter lens. While assembling, the lens 33 is first accommodated in the accommodation space 311 of the fastening cylinder 31 to be supported by the shield wall 312. The light distribution member 32 is then accommodated in the accommodation space 311 to be supported by the lens 33. The slots 313 of the fastening cylinder 31 correspond to coupling members, which are pre-locked, passing through the bottom coupling holes of the inner coupling hole columns 113 of the heat sink 11. The narrow slot portion of the slot 313 and the coupling member achieve a stable snapping effect by rotating. Accordingly, the assembling of the light distribution mechanism 3 and the light source device 1 can be completed. Moreover, the light source device 1 and the swing component 2 must be assembled. First, the light distribution mechanism 3 and a combination body of the LED light source 12 and the support rack 13 vertically pass through the large center hole 212 and the large slot 222 of the swing component 2 to allow the bottom surface of the heat sink 11 to be in contact with the coupling grip 215 of the upper sliding vane 21. Afterward, the assembly is slightly moved to enable the coupling hole 216 on the coupling grip 215 to align with the coupling hole on the bottom surface of the external coupling hole column 112 of the heat sink 11. A coupling member 217 further passes through the coupling hole 216 to lock together with the external coupling hole column 112. The completion of assembling the light source device 1 and the swing component 2 and the light distribution mechanism 3 can be done first.

With reference to FIGS. 1-3 and FIGS. 6-7, the rotation component 4 is composed of an upper rotation ring 41, an upper fastening ring 42 and a lower rotation ring 43. The upper rotation ring 41 is a ring-like body and opened with a large piercing hole 411 at its center. A positioning bump 412 upwardly protrudes and at least three sets of bottom flanges 413 downwardly protrude and are disposed on the upper rotation ring body while at least two sets of coupling holes 414 are synchronously disposed near an inner edge, and a screw hole 415 is opened thereto to screw a packing member 416. The upper fastening ring 42 is a ring-like body and opened with a large piercing hole 421. The ring-like body is further divided into an external ring wall 422 for fastening purposes and an inner ring wall 423 for positioning purposes. The inner ring body 423 is higher than the external ring wall 422. The height difference between both is to exactly accommodate the ring-like body's external edge (containing the height of the bottom flange 413). The external ring wall 422 is opened with a plurality of first piercing holes 424 passed by a coupling member 425 (rivet for example) from the top to down. A second piercing hole 426 is respectively opened near the first piercing hole 424. The second piercing hole 426 have holes respectively disposed at two sides of the first piercing hole 424 to conveniently select. An inner edge of the inner ring wall 423 is disposed with a position limiting bump 427. A large piercing hole 431 is opened at the center of the lower rotation ring 43 and can be any shape, such as a circle or a square, without restriction. Three arc strip grooves 432 are uniformly divided and surrounded on the ring body and provided for a coupling member 433 (screw bolt for example) to pass through from the bottom to top. In addition, a coupling hole 434 is respectively disposed at corners of the large piercing hole 431. The rotation component 4 incorporates a support rack mechanism 44 including a plate body 441 with a standing wall at its periphery combined into a square frame type fastened and mounted at the height places of a building. The support rack mechanism 44 includes a large mounting hole 443 in the plate body 441 and a set of a first coupling holes 444 and a set of a second coupling holes 445 surrounding the large mounting hole 443. The quantity and position of the set of first coupling holes 444 correspond to the first piercing hole 424 of the external ring wall 422. The quantity and diameter of the set of second coupling holes 445 correspond to the arc strip groove 432 of the lower rotation ring 43 and also correspond to the second piercing hole 426 on the external ring wall 422 at the same time. In addition, a set of third coupling holes 446 is further opened at the periphery of the large mounting hole 443. While assembling, the upper rotation ring 41 can be first and completely assembled to the swing component 2 as shown in FIGS. 1, 12. A coupling sheet body 225 of the lower guide flake 22 in the swing component 2 is attached to an inner edge of the upper rotation ring 41, and the positioning recess 227 on the coupling sheet body 225 first clamps the packing member 416, which is pre-screwed, into the screw hole 415 of the coupling sheet body 225 to achieve initial alignment and positioning. At this time, the connecting hole 26 of the coupling sheet body 225 is exactly aligned to the coupling hole 414 of the upper rotation ring 41. Thus, the coupling hole 414 and the connecting hole 226 are passed by a connecting member 228 to lock and connect. Next, the assembling of the rotation component 4 can be carried out. Firstly, the upper rotation ring 41 is placed on the plate body 441 of the support rack mechanism 44, and the bottom flange 413 of the upper rotation ring 41 stands on the plate body 441. At the same time, the large piercing hole 411 of the upper rotation ring 41 aligns with the large mounting hole 443 of the plate body 41. An external edge of the inner ring wall 423 of the upper fastening ring 42 aligns with the ring body external edge of the upper rotation ring 41 so that the external ring wall 422 of the upper fastening ring 42 is attached to the plate body 41, and it regulates to allow the first piercing hole 424 on the external ring wall 422 to align with the first coupling hole 444 of the plate body 441 one by one. Afterward, a coupling member 425, from the top to down, passes through the first piercing hole 424 and the first coupling hole 444 to couple the two together. The packing member 416 can be further tightly locked to downwardly and tightly prop against the plate body 441 so that the upper rotation ring 41 may not randomly rotate. Next, the lower rotation ring 43 is attached to a bottom surface of the plate body 441, and the large piercing hole 431 of the lower rotation ring 43 aligns with the large mounting hole 443 of the plate body 441. At the same time, the arc strip groove 432 of the lower rotation ring 43 aligns with the second coupling hole 445 of the plate body 441 and the second piercing hole 426 of the external ring wall 422 one by one. The coupling member 433 then vertically passes through the arc strip groove 432 of the lower rotation ring 43 and the second coupling hole 445 and the second piercing hole 426 to achieve couple. Accordingly, the upper rotation ring 41, the upper fastening ring 42 and the lower rotation ring 43 are completely assembled to the support rack mechanism 44. The assembling among the light source device 1, the swing component 2, the light distribution mechanism 3 and the support rack mechanism 44 can be further completed.

Figure 6:
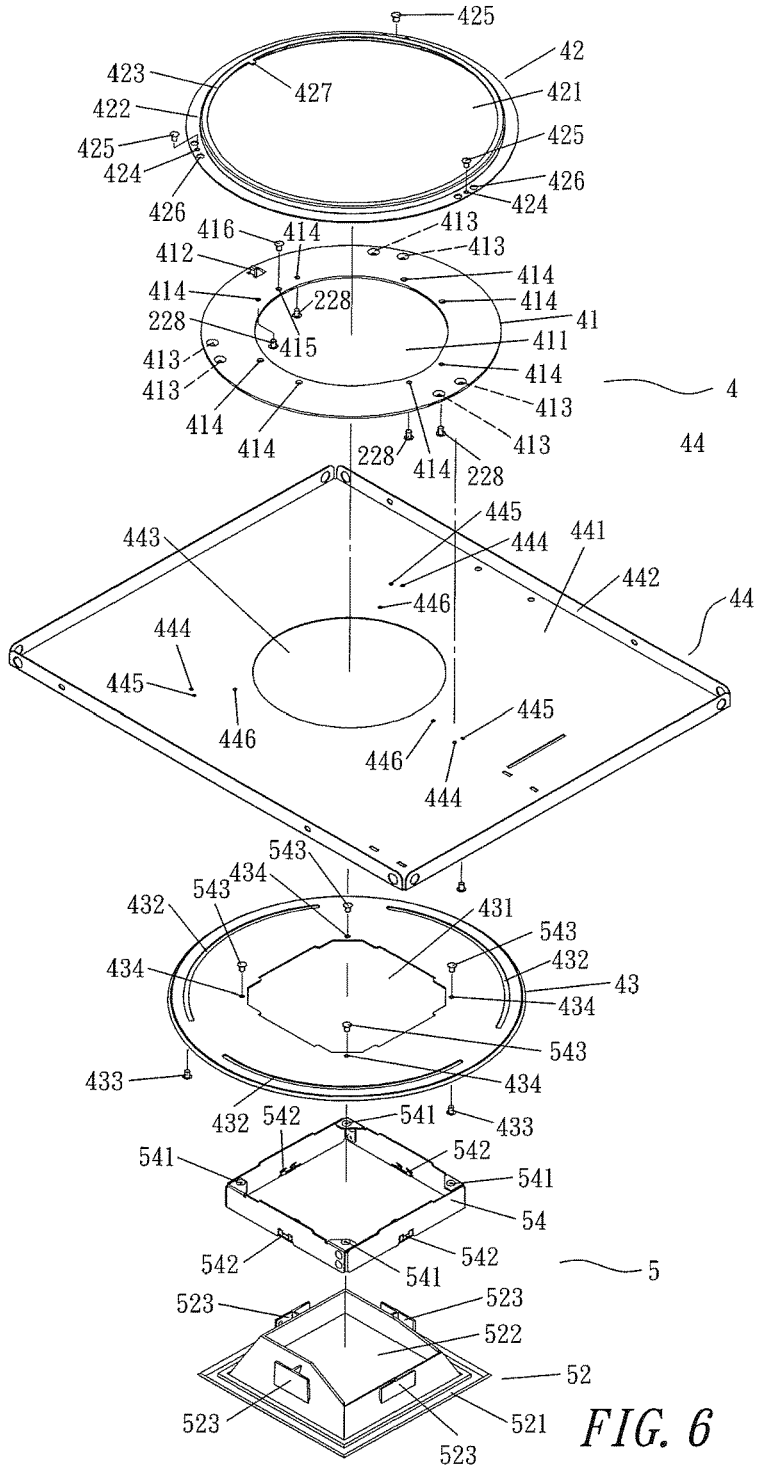
FIG. 6 is a three-dimensional decomposition drawing of a depression angle for partial structure in an embodiment of the invention.
Figure 7:
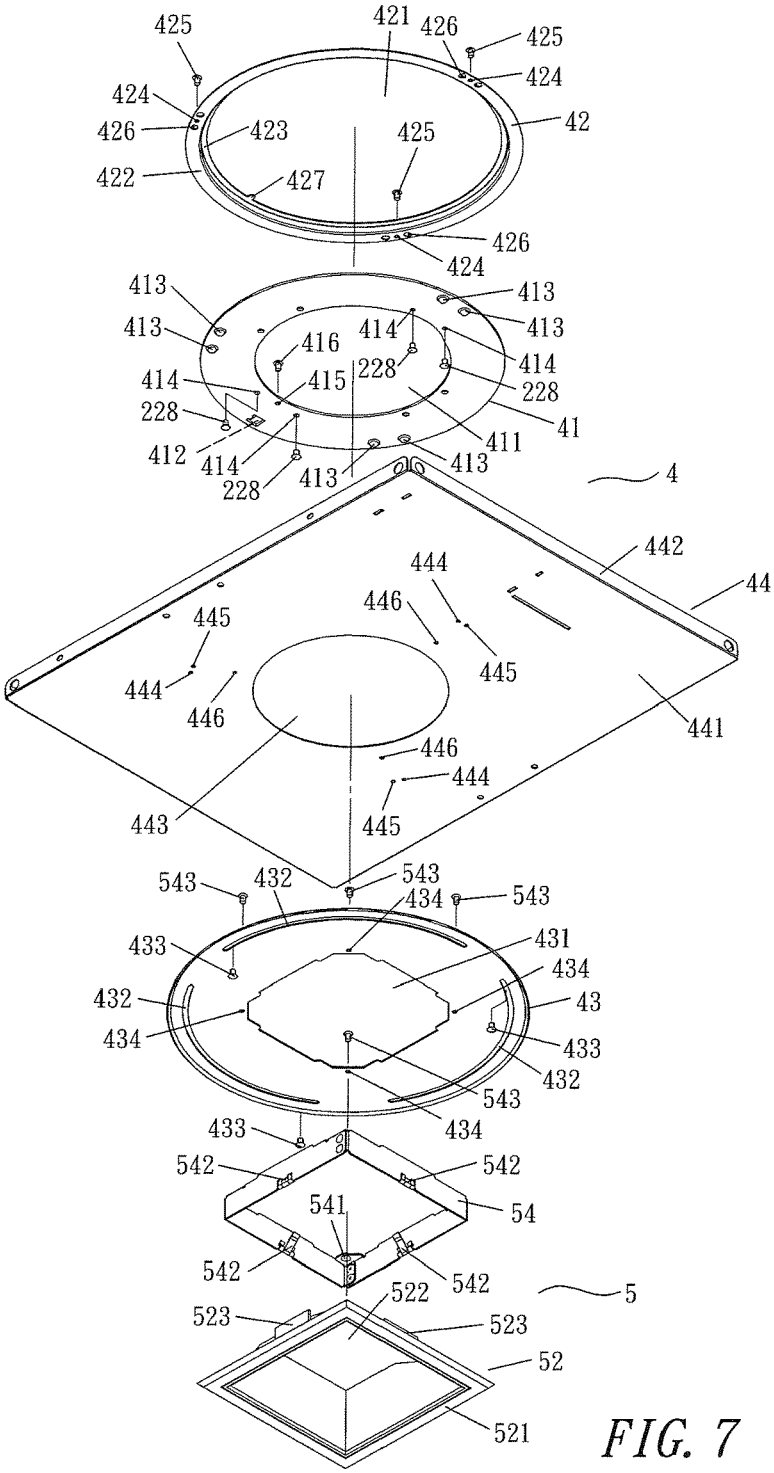
FIG. 7 is a three-dimensional decomposition drawing of an elevation angle for partial structure in an embodiment of the invention.

With reference to FIGS. 6, 7, the casing component 5 mainly has a reflective mask 52. The reflective mask 52 is an article having upper narrow and lower wide feature and can be any shape, for example, a square or circle, and is not limited during implementation. A wall 521 is formed at a bottom edge of an external surface of the reflective mask 52, wherein its center is a light hole 522 vertically penetrated and showing upper narrow and lower wide feature. The light hole 522 further includes an inclined-like side hole disposed toward a side except a top surface portion. An external surface of the reflective mask 52 has at least two coupling walls synchronously disposed. The casing component 5 further includes a coupling frame 54 that is a square frame, with its corners respectively disposed with a coupling hole 541, and a clamping member 542 is snapped at a periphery bottom edge thereto. The position of the coupling hole 541 corresponds to the coupling hole 434 disposed at corners of the large piercing hole 431 of the lower rotation ring 43 so that when the coupling frame 54 is attached to a bottom surface of the lower rotation ring 43 and the coupling hole 434 corresponds to the coupling hole 541 one by one, a coupling member 543 passes through the coupling hole 434 to couple the coupling hole 541 to stably assemble the coupling frame 54 at the bottom surface of the lower rotation ring 43. Afterward the reflective mask 52 is vertically placed from the bottom edge of the coupling frame 54 until the coupling wall 523 of the reflective mask 52 crosses over the clamping member 542 of the coupling frame 54 to achieve clamping effect.

Figure 8:
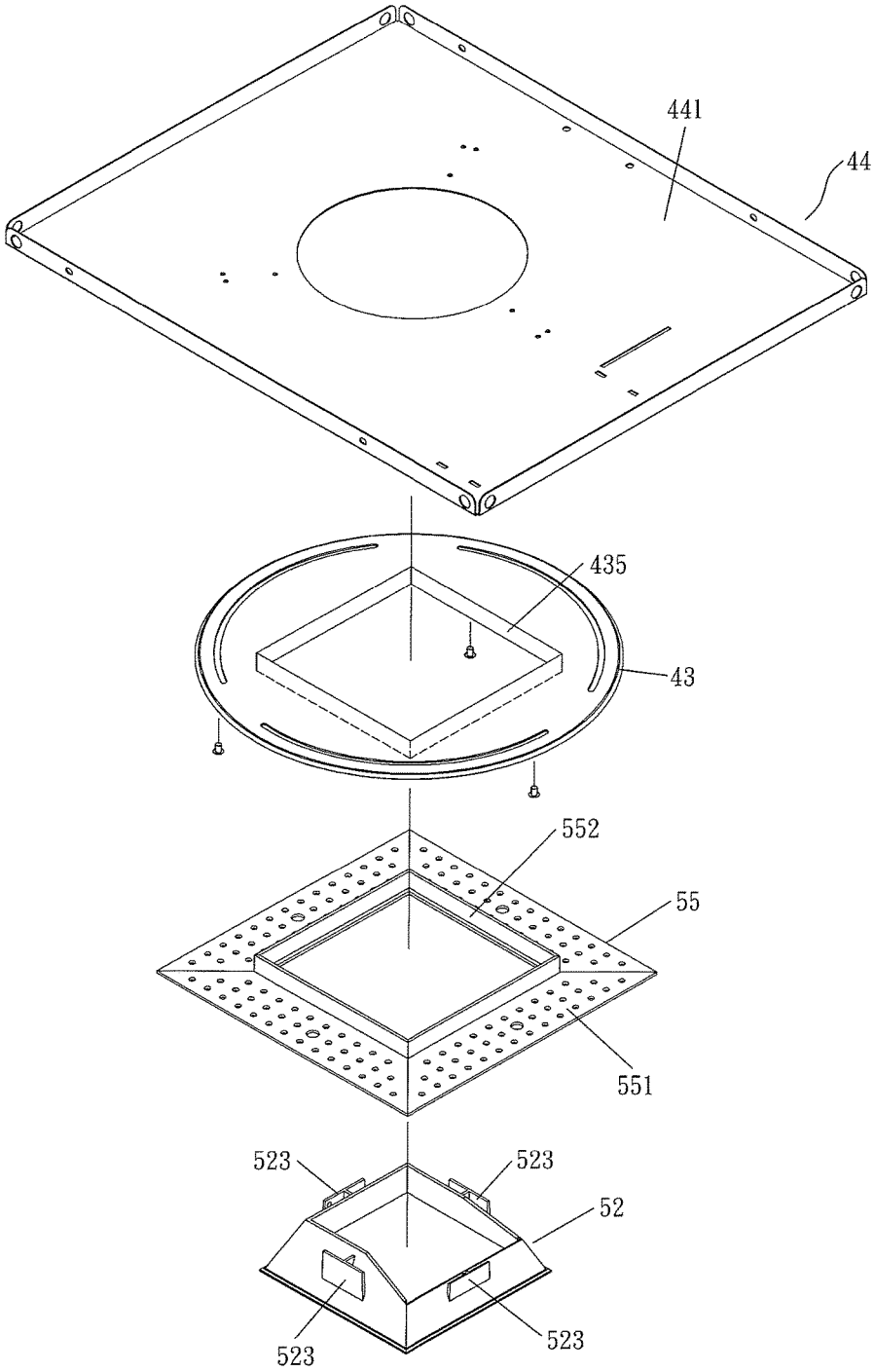
FIG. 8 is a three-dimensional decomposition drawing for a different partial structure in an embodiment of the invention.

The casing component 5 includes a reflective mask 52 that provides a light emitting hole 522 to guide the beam emitted by the light source device 1 to downwardly illuminate. Therefore, other different assembling structures can be placed between the reflective mask 52 and the lower rotation ring 43. With reference to FIG. 8, the casing component 5 can be a decoration frame 55 having a planar decoration tray 551, and a circularly standing wall 552 is raised at the center, and the lower rotation ring 43 is downwardly disposed with a vertical wall 435 at the periphery of the large piercing hole 431. While assembling, the standing wall 552 of the decoration frame 55 is pushed into the vertical wall 435 of the lower rotation ring 43 to achieve snapping and coupling. Afterward, the reflective mask 52 is accommodated from the bottom edge of the decoration frame 55 until the coupling wall 523 of the reflective mask 52 crosses over the standing wall 52 of the decoration framer 55 to achieve snapping and coupling.

The reflective mask 52 can be any shape, including a square or a circle, without restriction. Therefore, with reference to FIG. 9, the reflective mask 52 showing a circle is assembled with the coupling frame 56 showing a circle. The top surface of the coupling frame 56 is disposed with several coupling holes 561, and several clamping members 562 are disposed at the bottom edge. Under this configuration, the lower rotation ring 43 does not apply (it is not assembled). While assembling, the coupling frame 56 is directly attached to the bottom surface of the plate body 441, and the coupling hole 561 corresponds to the third coupling hole 446 of the plate body 441. A coupling member 563 is coupled to the third coupling hole 446 after passing through the coupling hole 561. Afterward, the reflective mask 52 is accommodated from the bottom edge of the coupling frame 56 until the coupling wall 523 of the reflective mask 52 crosses over the clamping member 562 of the coupling framer 56 to achieve clamping effect.

Figure 9:
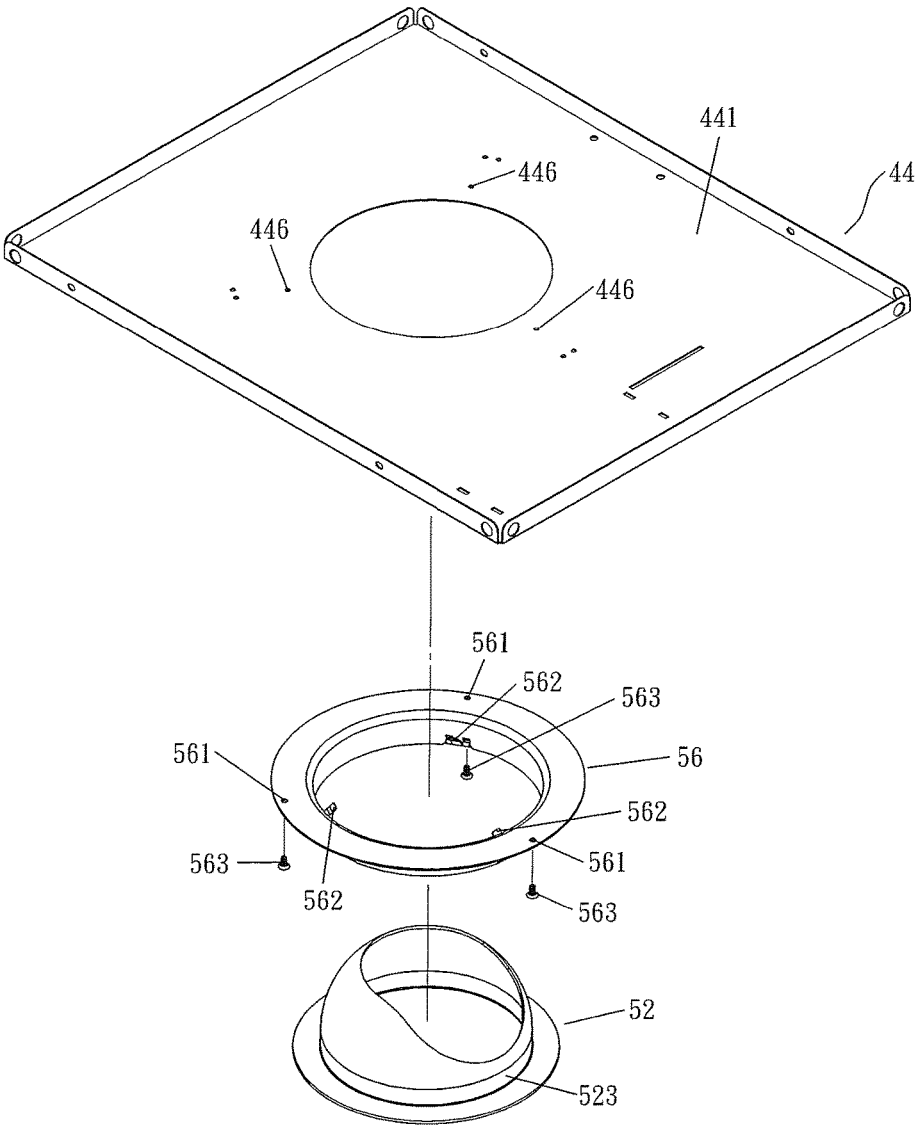
FIG. 9 is a three-dimensional decomposition drawing for a different partial structure in an embodiment of the invention.
Figure 10:
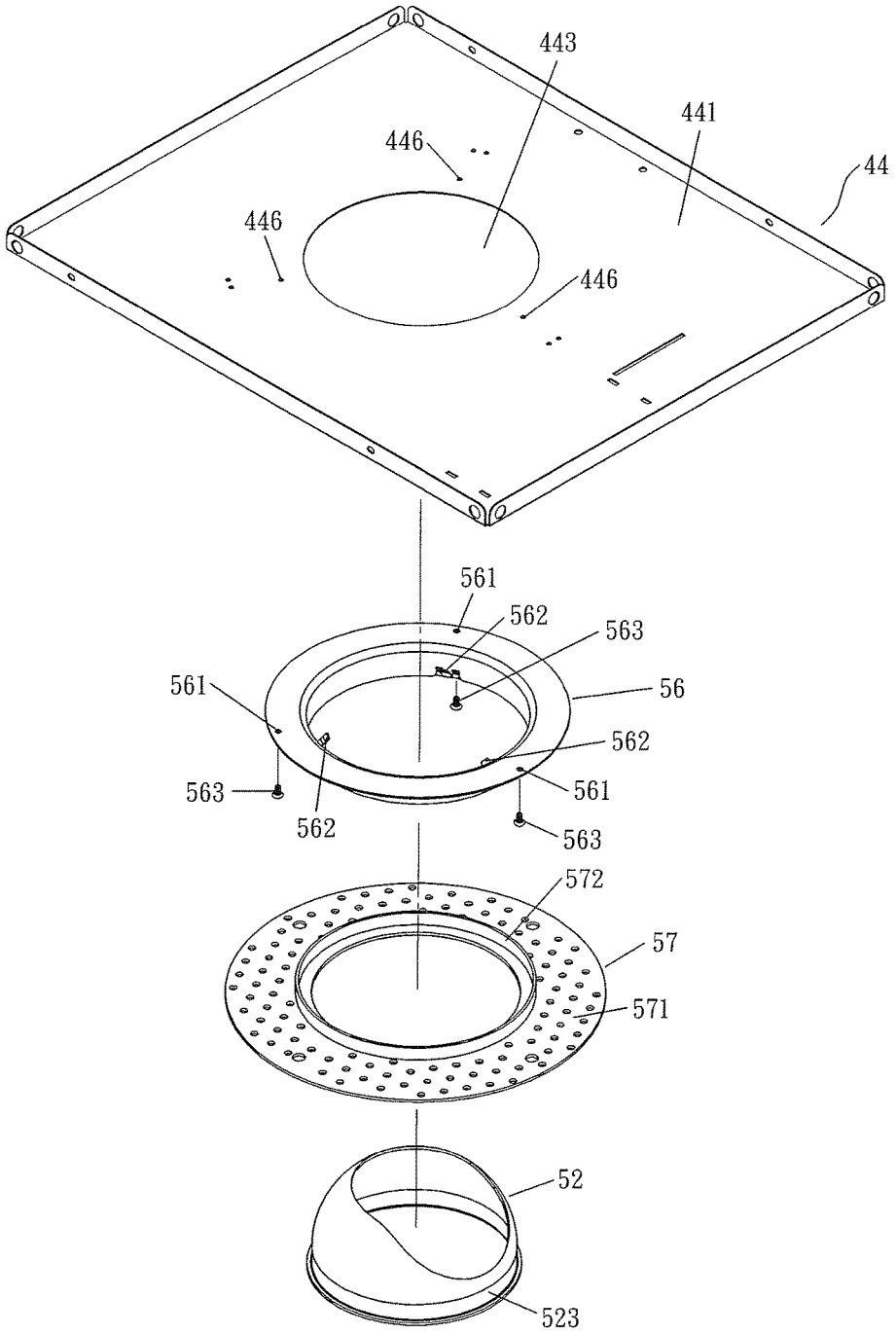
FIG. 10 is a three-dimensional decomposition drawing for a different partial structure in an embodiment of the invention.

Of course, with reference to FIG. 10, the reflective mask 52 showing a circle and the decoration frame 57 showing a circle are assembled to the coupling frame 56. The decoration frame 56 has a planar decoration tray 571 and a circularly standing wall 572 upwardly raised. The coupling frame 56 is shown in FIG. 9. Under this configuration, the lower rotation ring 43 does not apply as well (it is not assembled). While assembling, the coupling frame 56 is first locked to the bottom surface (as shown in FIG. 9) of the plate body 441. The standing wall 572 of the decoration frame 57 is pushed into the coupling frame 56 to achieve snapping and coupling. The reflective mask 52 is accommodated from the bottom edge of the decoration frame 57 until the coupling wall 523 of the reflective mask 52 crosses over the standing wall 572 of the decoration frame 57 to achieve snapping and coupling.

With reference to FIG. 1, the power source device 6 is mounted on the plate body 441 of the support rack mechanism 44. The power source device 6 can include a junction box 61 and a driver 62, with the junction box 61 supplied by supply mains to conduct power to the driver 62. The driver 62 performs circuit finishing work of step-down and regulator rectification therein. The LED light source 12 then is driven to emit light. Since current light source (the LED light source 12 for example) has low heat generation and low power consumption, in a ceiling or high location of a building, a plurality of downlights 10 located at different disposition points is cascaded by the same power source. At this time, the junction box 61 can conduct power to the downlight 10 at another disposition point.

Figure 11:
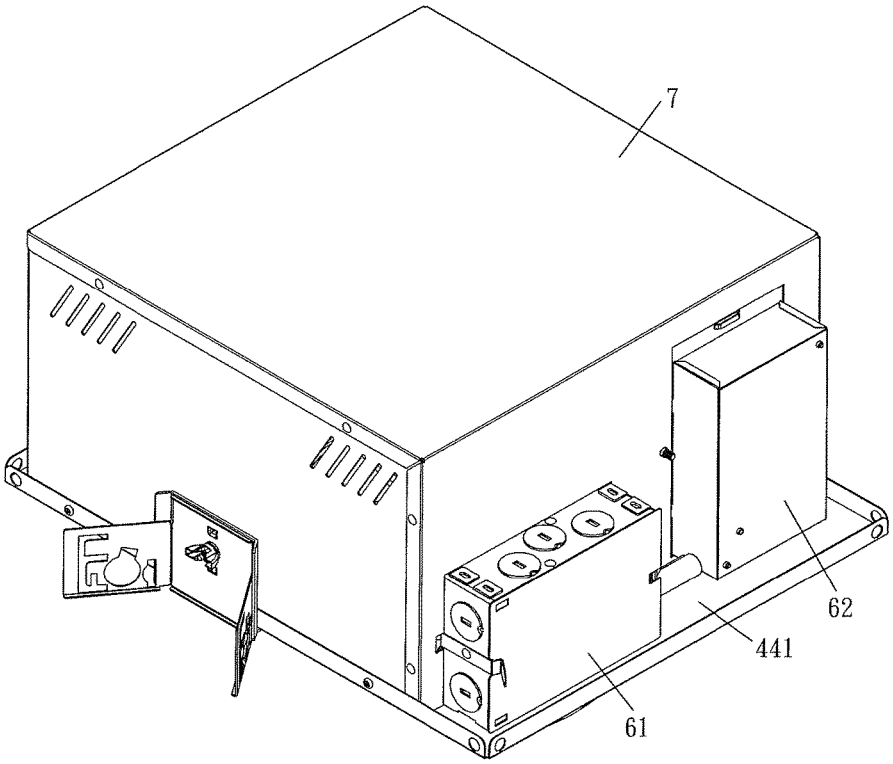
FIG. 11 is a three-dimensional drawing of an assembling of covering an insulation case according to an embodiment of the invention.

Several portions of current building are paved with fireproof cottons to achieve fireproof effect. However, with reference to FIGS. 1, 12 for the downlight 10, since the heat sink 11 does not have a cover, it may not be in contact with fireproof cottons. The invention can be shown as FIG. 11 in which the plate body 441 of the support rack mechanism 44 is covered with an insulation case 7 for covering the portion of the downlight 10 located above the plate body 441. Accordingly, the insulation case 7 can be in contact with fireproof cottons to increase the fireproof effect.

The downlight 10 according to an embodiment of the invention will generate the following usage status depending upon whether or not the upper sliding vane 21 of the swing component 2 performs a motion of deflecting an angle with respect to the lower guide flake 22 and whether or not the upper rotation ring and the lower rotation ring 43 carry out a motion of rotating an angle on a horizontal plane:

1. With reference to FIGS. 1, 12, when the upper sliding vane 21 of the swing component 2 is retained at the upper position of the lower guide flake 22 (as the standing status), the upper rotation ring 41 and the lower rotation ring 43 do not perform any rotation motion on a horizontal plane. The LED light source 12 vertically and downwardly projects a beam. When the beam passes through the light distribution member 32 of the light distribution mechanism 3, the beam range will diffuse. When diffused beam then downwardly passes through the reflective mask 52 of the casing component 5, the beam range will further diffuse so that the beam can pass through the light emitting hole 522 to project a large field of beam to the lower space.

Figure 13:
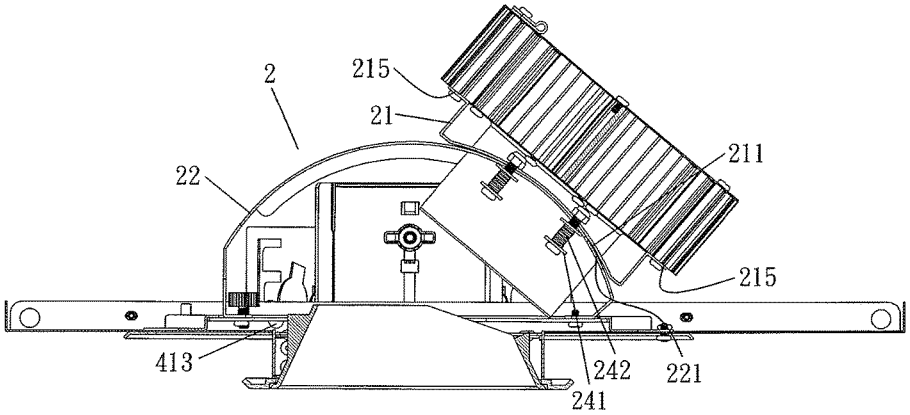
FIG. 13 is a front elevation drawing of a second using status according to an embodiment of the invention.

2. With reference to FIG. 13, the upper sliding vane 21 of the swing component 2 can tilt toward a side (right side shown in the figure), and selectively perform a deflection motion at a certain degree from original standing status. The coupling grips 215 at two sides of the upper sliding vane 21 are held upwardly by hands to allow each lower gasket 241 to push correspondingly elastic members 242 that are upwardly moved and compressed so that the main slice body 211 of the upper sliding vane 21 and the main sheet body 221 of the lower guide flake 22 are not pressed. Accordingly, the upper sliding vane 21 is held to move along the narrow guide slot 223 of the lower guide flake 22. After reaching a proper position, the coupling grips 215 at two sides of the upper sliding vane 21 held by hands are released. The main slice body 211 of the upper sliding vane 21 is re-attached to the main sheet body 221 of the lower guide flake 22 by an elastic force generated from the elastic member 242 such that the upper sliding vane 21 of the swing component 2, directed toward a side, selectively performs a deflection motion at a certain angle and can be operated anytime to deflect toward the middle so as to restore as standing status shown in FIG. 12.

3. With reference to FIG. 13, while operating the upper sliding vane 21 of the swing component 2 to perform a deflection motion at a certain degree, the light source device 1 and the light distribution mechanism 3 assembled to the upper sliding vane 21 are deflected synchronously. The direction of beam projected by the LED light source 12 is accordingly changed to obliquely project toward another side from the original vertical downward direction. Since the light emitting hole 522 of the reflective mask 52 includes the top surface portion and side hole inclined toward a side, the light emitting hole 522 (comprising the side hole) of the reflective mask 52 can be entirely passed by the obliquely projected beam without any obstruction after moving the swing rack 2 to perform the deflection motion.

Figure 14:
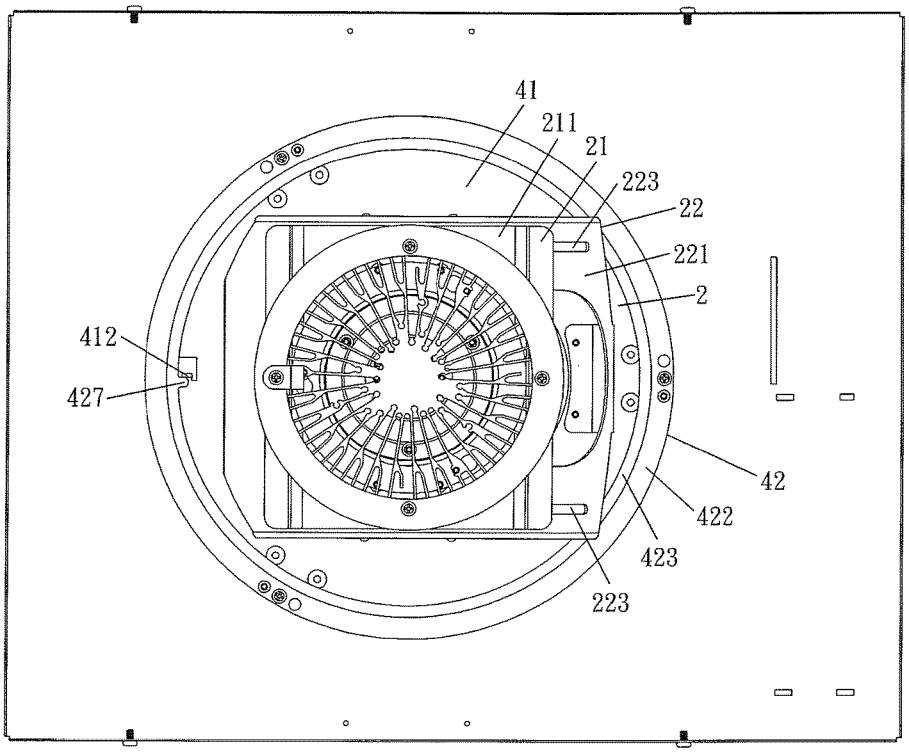
FIG. 14 is a top view of a first using status according to an embodiment of the invention.
Figure 15:
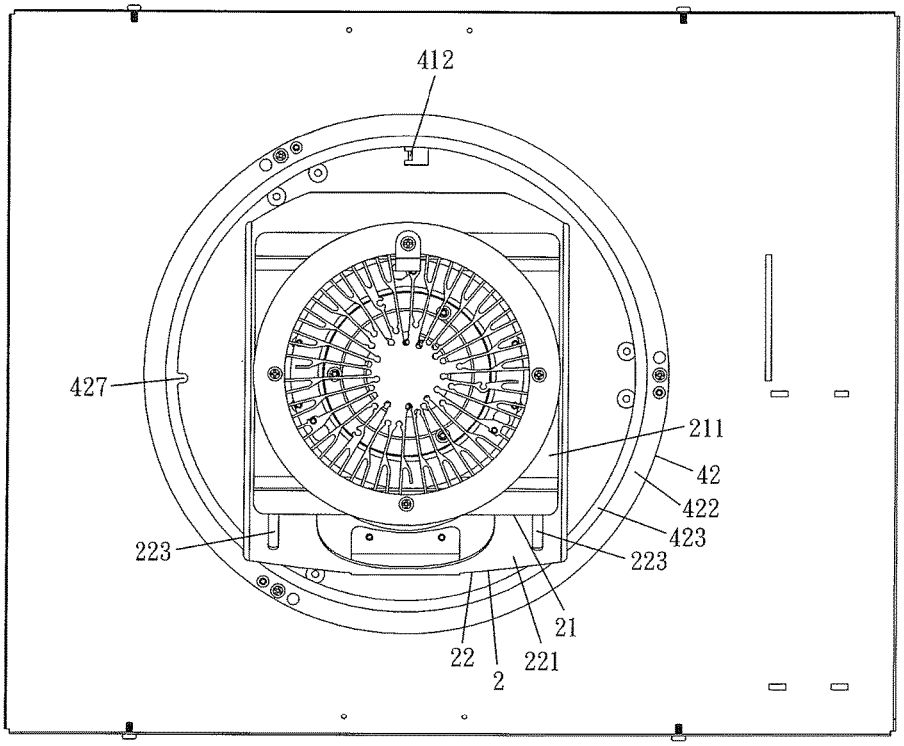
FIG. 15 is a top view of a third using status according to an embodiment of the invention.

4. FIG. 14 is a top view of FIG. 12 to represent that the upper sliding vane 21 of the swing component 2 does not perform any deflection motion (retaining the standing status) on the vertical plane. Please refer to FIG. 15 from FIG. 14, the upper rotation ring 41 carries out rotation motion at a certain degree on the horizontal plane together with the swing component 2. Since the ring body of the upper rotation ring 41 is covered by the inner ring wall 423 of the upper fastening ring 42, and the upper fastening ring 42 is locked by the first coupling member 425, the upper rotation ring 41 can rotate within the range of the inner ring wall 423 without extrication. While in operation, the packing member 416 propping the upper rotation ring 41 must be firstly released, and force is imposed to push the swing rack 2 to link the upper rotation ring 41 for synchronous rotating. After rotating to a new position, the packing member 416 is locked again to tightly re-prop the upper rotation ring 41. FIG. 15 shows 90 degree of rotation from FIG. 14. In the process, the bottom flange 413 can reduce friction between the upper rotation ring 41 and the plate body 441 during rotation. At the same time, since the positioning bump 412 of the upper rotation ring 41 is restricted by the position limiting bump 427 of the inner ring wall 423, the upper rotation ring 41 can merely rotate in single direction and then turns around, and its rotation degree is unable to exceed 360 degrees. Thus, the design can be set from 0 degrees to 355 degrees.

Figure 16:
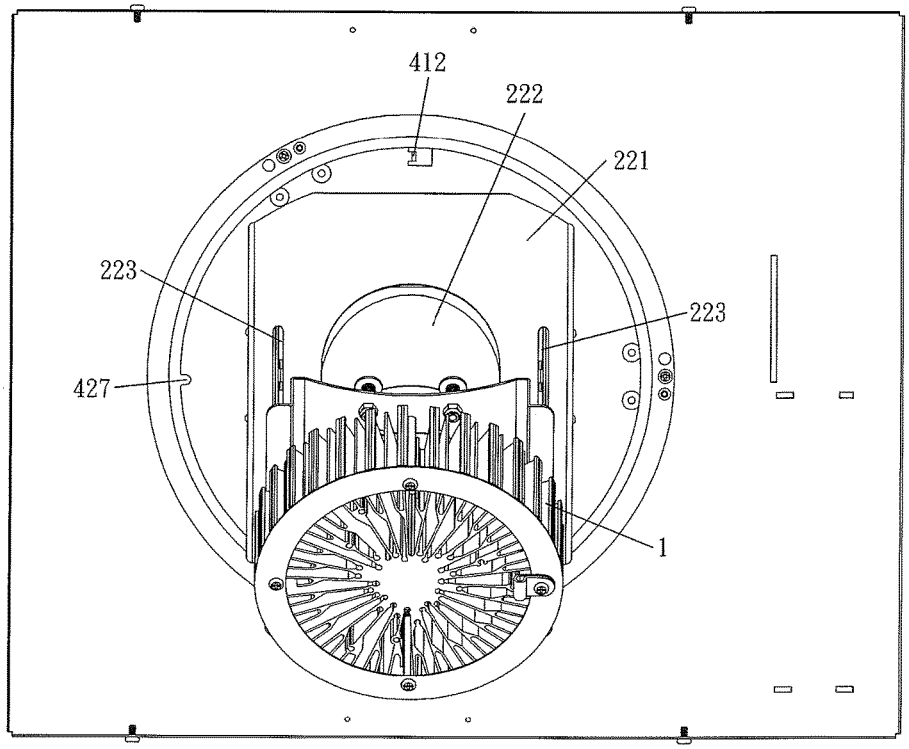
FIG. 16 is a top view of a fourth using status according to an embodiment of the invention.

5. FIG. 15 represents that after the upper rotation ring 41 carrying out rotation motion at a certain degree on the horizontal plane together with the swing component 2 is completed, with reference to FIG. 16, the swing component 2, toward a side, performs a deflection motion at a certain degree from original standing status. Since it performs both horizontal rotation and vertical deflection, the direction of the LED beam projection will be simultaneously regulated to the position required for rotation.

6. Since the lower rotation ring 43 is attached to the bottom surface of the plate body 441 and the coupling member 433 passes through the arc strip groove 432 to correspondingly couple the second coupling hole 445 of the plate body 441, the coupling member 433 is taken as restriction point to rotate the lower rotation ring 43. Its rotation angle range is the angle range of the arc strip groove 432. While rotating the lower rotation ring 43, the reflective mask 52 and the coupling frame 54 and/or the decoration frame 54 are driven to rotate. Since the coupling frame 54 and the decoration frame 55 are squares, edges of the coupling frame 54 or the decoration frame 55 can be regulated by rotation so that it can be identical to the wall surface direction of the building so as to increase beauty.

Upon the foregoing, the downlight 10 of the invention can be conveniently assembled. Two-way rotation functions of horizontal rotation and vertical swing can be operated while in use so that a user can select and regulate a required beam projection direction and angle to have stronger practicality in illumination.

While the invention has been described by means of specific embodiments, numerous modifications and variations could be made thereto by those skilled in the art without departing from the scope and spirit of the invention set forth in the claims.

What is claimed is:

1. A light-emitting diode (LED) downlight capable of regulating an illumination angle comprising:

at least a light source device, a swing component, a light distribution mechanism, a rotation component, a casing component, and a power source device, with the light source device including a heat sink, an LED light source and a support rack, the heat sink composed of a central solid body outwardly arranged to show heat dissipation slices of scattered arrangement;

the LED light source supported by the support rack and coupled to a bottom surface of the heat sink, a center of the support rack opened with a large piercing hole provided for the LED light source to downwardly project a LED beam;

the swing component including an upper sliding vane and a lower guide flake, the upper sliding vane having a main slice body with a curved shape and a large center hole at its center and a set of through holes on one set of two opposite side edges and respectively raised with a coupling grip at the other set of two opposite side edges;

the lower guide flake having a main sheet body having a curved shape and a large slot, the curved shape of the main sheet body of the lower guide flake corresponding to curved shape of the main slice body of the upper sliding vane, the main sheet body of the lower guide flake having a narrow guide slot on one set of two opposite side edges and respectively and downwardly bent to form a support sheet body along the other set of two opposite side edges, a bottom of the support sheet body further bent to form a coupling sheet body;

the upper sliding vane placed on the lower guide flake so that the set of through holes on the one set of two opposite side edges of the upper sliding vane respectively align with the narrow guide slots on the one set of two opposite side edges of the lower guide flake, a regulation screw member first passing through a lower gasket, an elastic member and an upper gasket and locked with a nut after passing through the narrow guide slot of the lower guide flake and the through hole of the upper sliding vane, the nut pushed to downwardly prop the main slice body of the upper sliding vane to attach the main sheet body of the lower guide flake through effect of elastic force of the elastic member;

the light distribution mechanism including at least one fastening cylinder and a light distribution member, a top portion and a bottom portion of the fastening cylinder opened to inwardly form an accommodation space, the fastening cylinder remaining a shield wall at bottom periphery, a wall body of the top portion of the fastening cylinder opened with a plurality of slots, the light distribution member accommodated in the accommodation space of the fastening cylinder to be supported by the shield wall, the slot of the fastening cylinder further snapped with a bottom surface of the heat sink;

the light distribution mechanism and a combination body of the LED light source and the support rack vertically passing through the large center hole and the large slot of the swing component to allow the bottom surface of the heat sink to be in contact with the coupling grip of the upper sliding vane, a coupling member further passing through the coupling grip to couple the bottom surface of the heat sink; the rotation component including at least an upper rotation ring and an upper fastening ring, the upper rotation ring being a ring body and opened with a large piercing hole at its center and disposed with at least two sets of coupling holes synchronously disposed and near an inner edge;

the upper fastening ring being a ring body and having a large piercing hole at its center, the ring body further divided into an external ring wall and an inner ring wall, the inner ring wall being higher than the external ring wall;

the rotation component incorporated with a support rack mechanism, the support rack mechanism having a plate body, the plate body opened with a large mounting hole; the upper rotation ring placed on the plate body of the support rack mechanism, the large piercing hole of the upper rotation ring aligning the large mounting hole of the plate body to cover the inner ring wall of the upper fastening ring on the upper rotation ring, after the external ring wall of the upper fastening ring attaching the plate body, a coupling member coupling the plate body by passing through the external ring body of the upper fastening ring; a connecting sheet body of the lower guide flake in the swing component attached on the upper rotation ring, a coupling member passing through the connecting sheet body to couple the upper rotation ring; the casing component having a reflective mask, the reflective mask having a narrow upper portion and a wide lower portion and formed with a wall at a bottom edge of an external surface and having a cone shaped light hole, which is vertically penetrated and shows the narrow upper portion and the wide lower portion, at its center, the light hole further comprising an inclined side hole disposed toward a side except a top surface portion, an external surface of the reflective mask having at least two coupling walls synchronously disposed;

the reflective mask accommodated in the large mounting hole of the plate body of the support rack mechanism; and the power source device disposed on the plate body of the support rack mechanism and introduced by receiving supply mains to perform circuit finishing work of regulator rectification therein, thereby transmitting and driving the LED light source to emit light.

2. The LED downlight capable of regulating an illumination angle of claim 1, wherein the light distribution member is a lens or a reflective cup.

3. The LED downlight for regulating an illumination angle of claim 1, wherein the light distribution mechanism comprises a lens, and the lens is first accommodated in the accommodation space of the fastening cylinder to be supported by the wall during assembling, and the light distribution member is further accommodated in the accommodation space to be supported by the lens.

4. The LED downlight capable of regulating an illumination angle of claim 1, wherein the rotation component further comprises a lower rotation ring, and a center of the lower rotation ring has a large piercing hole, and three arc strip grooves uniformly surround the ring body, and the lower rotation ring is attached to a bottom surface of the plate body during assembling, and the large piercing hole of the lower rotation ring aligns the large mounting hole of the plate body, and a coupling member is coupled to the plate body after passing through the arc strip groove of the lower rotation ring.

5. The LED downlight capable of regulating an illumination angle of claim 4, wherein the casing component comprises a coupling frame, and the coupling frame is coupled to a bottom surface of the large piercing hole of the lower rotation ring, and a clamping member is snapped at a periphery bottom edge of the coupling ring, and the reflective mask is accommodated from a bottom edge of the coupling ring until the coupling wall of the reflective mask crosses over the clamping member of the coupling frame.

6. The LED downlight capable of regulating an illumination angle of claim 4, wherein the casing member comprises a decoration frame having a planar decoration tray while a standing wall raises from its middle, and the upper rotation ring is downwardly disposed with a vertical wall at a periphery of the large piercing hole to push the standing wall of the decoration ring into the vertical wall of the lower rotation ring, and the reflective mask is accommodated from a bottom edge of the decoration frame until the coupling wall of the reflective mask crosses over the standing wall of the decoration frame.

7. The LED downlight for regulating an illumination angle of claim 1, wherein the casing member comprises a coupling frame, and the coupling frame is directly attached to a bottom surface of the large mounting hole of the plate body, and a clamping member is snapped at a periphery bottom edge of the coupling frame, and the reflective mask is accommodated from a bottom edge of the coupling frame until the coupling wall of the reflective mask crosses over the clamping member of the coupling frame.

8. The LED downlight capable of regulating an illumination angle of claim 7, wherein the casing component comprises a decoration frame having a planar decoration tray while a standing wall raises from its middle, and the coupling frame is firstly attached and coupled to a bottom surface of the large mounting hole of the plate body, and the standing wall of the decoration ring is pushed into the coupling fame, and the reflective mask is accommodated from a bottom edge of the decoration frame until the coupling wall of the reflective mask crosses over the standing wall of the decoration frame.

9. The LED downlight capable of regulating an illumination angle of claim 1, wherein at least three sets of downwardly protruding bottom flanges are disposed on a wall body of the upper rotation ring.

10. The LED downlight capable of regulating an illumination angle of claim 1, wherein an upwardly protruding positioning bump is disposed on the wall body of the upper rotation ring, and a position limiting bump is disposed at an inner edge of the inner ring wall of the upper fastening ring, and the positioning bump is limited by the position limiting bump while rotating the upper rotation ring so that it is rotated in one direction and then rotated reversely.

11. The LED downlight capable of regulating an illumination angle of claim 1, wherein a packing member is screwed on the wall body of the upper rotation ring to position the upper rotation ring through packing effect.

12. The LED downlight capable of regulating an illumination angle of claim 1, wherein an insulation case covers the plate body of the support rack mechanism to cover a portion of the downlight above the plate body so that the insulation case is in contact with a fireproof foam, thereby increasing fireproof effect.

13. The LED downlight capable of regulating an illumination angle of claim 1, wherein the power source device comprises a junction box and a driver, and the junction box supplied by supply mains to conduct power to the driver, and the driver performs circuit finishing work of regulator rectification therein, thereby transmitting power and driving the LED light source to emit light.

* * * * *